US010006174B2

(12) United States Patent
Ulislam

(10) Patent No.: US 10,006,174 B2
(45) Date of Patent: Jun. 26, 2018

(54) PAVEMENT SLAB

(71) Applicant: Jersey Precast Corporation, Inc., Hamilton Township, NJ (US)

(72) Inventor: Amir Ulislam, Neshanic Station, NJ (US)

(73) Assignee: Jersey Precast Corporation, Inc., Hamilton Township, NJ (US)

( * ) Notice: Subject to any disclaimer, the term of this patent is extended or adjusted under 35 U.S.C. 154(b) by 0 days. days.

(21) Appl. No.: 15/679,775

(22) Filed: Aug. 17, 2017

(65) Prior Publication Data

US 2018/0051424 A1 Feb. 22, 2018

Related U.S. Application Data

(60) Provisional application No. 62/337,273, filed on Aug. 19, 2016.

(51) Int. Cl.

| | |
|---|---|
| ***E01C 11/04*** | (2006.01) |
| ***E01C 5/06*** | (2006.01) |
| ***E01C 11/16*** | (2006.01) |
| ***E01C 9/00*** | (2006.01) |
| ***E01C 5/00*** | (2006.01) |

(52) U.S. Cl.

CPC ..... *E01C 11/04* (2013.01); *E01C 5/005* (2013.01); *E01C 5/06* (2013.01); *E01C 11/16* (2013.01); *E01C 9/00* (2013.01)

(58) Field of Classification Search

CPC ..... E01C 11/18; E01C 11/24; E01C 5/005; E01C 5/06; E01C 5/00; E01C 2201/02; E01C 9/086; E01C 9/08

See application file for complete search history.

(56) References Cited

U.S. PATENT DOCUMENTS

| | | | | |
|---|---|---|---|---|
| 1,991,931 A | | 2/1935 | Kling et al. | |
| 4,362,426 A | | 12/1982 | Ruckstuhl | |
| 5,586,834 A | * | 12/1996 | Tsuji | E01C 5/005 404/60 |
| 5,593,744 A | * | 1/1997 | Van Vechten | F16L 9/14 138/103 |

(Continued)

OTHER PUBLICATIONS

International Search Report and Written Opinion issued by the U.S. Patent and Trademark Office in International Application No. PCT/US14/23546.

(Continued)

*Primary Examiner* — Abigail A Risic
(74) *Attorney, Agent, or Firm* — Greenberg Traurig, LLP

(57) ABSTRACT

A pavement slab includes a top surface, a bottom surface opposite the top surface, first and second longitudinal side surfaces, each of which extends from the top surface to the bottom surface, and first and second transverse side surfaces, each of which extends from the top surface to the bottom surface. At least one transverse tube is positioned intermediate the top surface and the bottom surface and extends from an inlet at the first longitudinal side surface to a second end intermediate the first and second longitudinal side surfaces. The at least one transverse tube is sized and shaped to convey a binder material. At least one vertical tube extends from each of the at least one transverse tube to the bottom surface. The at least one vertical tube is sized and shaped to convey the binder material.

18 Claims, 6 Drawing Sheets

(56) References Cited

U.S. PATENT DOCUMENTS

| | | | | |
|---|---|---|---|---|
| 5,626,289 | A | 5/1997 | Demers, Jr. et al. | |
| 5,682,635 | A | 11/1997 | Tolliver et al. | |
| 5,797,231 | A | 8/1998 | Kramer | |
| 6,558,071 | B1 * | 5/2003 | Sproules | E01C 5/08 404/78 |
| 6,607,329 | B2 | 8/2003 | Smith | |
| 6,663,315 | B2 | 12/2003 | Smith | |
| 6,709,192 | B2 | 3/2004 | Smith | |
| 6,827,521 | B2 * | 12/2004 | Sproules | E01C 5/08 404/17 |
| 6,899,489 | B2 | 5/2005 | Smith | |
| 6,962,462 | B2 | 11/2005 | Smith | |
| 7,004,674 | B2 | 2/2006 | Smith | |
| 7,134,805 | B2 | 11/2006 | Yee | |
| 7,467,776 | B2 | 12/2008 | Smith | |
| 7,677,832 | B2 | 3/2010 | Yee | |
| 8,511,935 | B1 * | 8/2013 | Thomas | E01C 11/14 404/135 |
| 8,636,441 | B2 | 1/2014 | French | |
| 8,756,898 | B1 * | 6/2014 | Backhaus | E04B 5/023 404/47 |
| 8,840,336 | B2 | 9/2014 | Smith | |
| 9,139,962 | B2 | 9/2015 | Smith | |
| 9,340,930 | B2 * | 5/2016 | Sylvester | E01C 5/06 |
| 2002/0170259 | A1 | 11/2002 | Ferris | |
| 2004/0200173 | A1 * | 10/2004 | Drake | E01C 7/147 52/514.5 |
| 2013/0115000 | A1 * | 5/2013 | Smith | E01C 11/02 404/40 |
| 2014/0270947 | A1 * | 9/2014 | Ulislam | E01C 5/005 404/40 |
| 2015/0010354 | A1 * | 1/2015 | Sylvester | E01C 5/06 404/34 |
| 2015/0078822 | A1 * | 3/2015 | Backhaus | E01C 5/06 404/47 |
| 2015/0167260 | A1 * | 6/2015 | Siqueiros | E01C 5/06 404/73 |
| 2017/0022726 | A1 * | 1/2017 | Sun | E04H 1/04 |
| 2017/0191227 | A1 * | 7/2017 | Sylvester | E01C 5/005 |

OTHER PUBLICATIONS

"Super-Slab™ Precast Pavement Slab System", Product Profile, The Fort Miller Co., Inc., http://www.fortmiller.com.

"Kwik Slab—Interlocking Roadway Systems", Roadway Repair Solutions, http://www.kwikslab.com.

* cited by examiner

PAVEMENT SLAB

CROSS-REFERENCE TO RELATED APPLICATION

This application is a Section 111(a) application relating to and claiming the benefit of commonly owned, U.S. Provisional Patent Application No. 62/377,273, titled "PAVING SLAB," having a filing date of Aug. 19, 2016, which is incorporated by reference herein in its entirety.

FIELD OF THE INVENTION

The present invention relates to precast pavement slabs and, more particularly, to precast pavement slabs that require a stratum of grout or other binding material underneath them.

BACKGROUND OF THE INVENTION

Pavement slabs are used in the construction, replacement and repair of facilities such as roadways, runways, parking areas, pathways and the like. The secure binding of each pavement slab to an underlying subgrade is an important element in the construction and subsequent durability of such facilities. What is needed is a pavement slab including a binder distribution system that is not exposed to the top of the slab to maximize the durability of such a slab, and at the same time ensures the distribution of binding material under the entire area of the slab.

SUMMARY OF THE INVENTION

In an embodiment, a pavement slab includes a plurality of transverse grout tubes extending from a first longitudinal side of the pavement slab toward a second longitudinal side of the pavement slab. A plurality of vertical grout tubes extend from each of the transverse grout tubes toward and through a bottom surface of the pavement slab. In an embodiment, foam tape is affixed to the bottom surface of the pavement slab and positioned so as to subdivide the bottom surface into a plurality of regions, each of the plurality of regions corresponding to one of the transverse grout tubes. In an embodiment, the pavement slab also includes a plurality of fill indicator tubes, each of which corresponds to one of the transverse grout tubes. In an embodiment, each of the fill indicator tubes extends from a first end at the bottom surface of the slab to a second end above a top surface of the slab.

In an embodiment, a pavement slab includes a top surface, a bottom surface opposite the top surface, first and second longitudinal side surfaces, each of which extends from the top surface to the bottom surface, and first and second transverse side surfaces, each of which extends from the top surface to the bottom surface, the pavement slab also including at least one transverse tube positioned intermediate the top surface and the bottom surface and extending from an inlet at the first longitudinal side surface to a second end intermediate the first and second longitudinal side surfaces, the at least one transverse tube being sized and shaped to convey a binder material; the pavement slab also including at least one vertical tube extending from each of the at least one transverse tube to the bottom surface, the at least one vertical tube being sized and shaped to convey the binder material.

In an embodiment, wherein the at least one transverse tube includes a plurality of transverse tubes. In an embodiment, the at least one vertical tube extending from each of the at least one transverse tube includes a plurality of vertical tubes extending from each of the at least one transverse tube.

In an embodiment, the pavement slab also includes a grout-impermeable barrier extending around a perimeter of the bottom surface. In an embodiment, the grout-impermeable barrier includes foam tape affixed to the bottom surface. In an embodiment, the grout-impermeable barrier further extends across the bottom surface to subdivide the bottom surface into a plurality of regions, wherein the at least one transverse tube includes a plurality of transverse tubes, and wherein each of the plurality of transverse tubes is positioned within a corresponding one of the plurality of regions.

In an embodiment, a distance between a first one of the plurality of transverse tubes and a second one of the plurality of transverse tubes is configured so as to enable the binder material to flow across an entirety of the bottom surface while remaining in a liquid state. In an embodiment, the distance between a first one of the plurality of transverse tubes and a second one of the plurality of transverse tubes is in a range between three feet and five feet. In an embodiment, a distance between the first one of the plurality of transverse tubes and the first transverse side surface is in a range between one foot and four feet. In an embodiment, a distance between a first one of the at least one vertical tube extending from a first one of the at least one transverse tube and a second one of the at least one vertical tube extending from the first one of the at least one transverse tube is configured so as to enable the binder material to flow across an entirety of the bottom surface while remaining in a liquid state. In an embodiment, the distance between the first one of the at least one vertical tube and the second one of the at least one vertical tube is in a range between one foot and four feet. In an embodiment, each of the at least one vertical tube is positioned such that no point on the bottom surface is more than three feet from one of the at least one vertical tube.

In an embodiment, the pavement slab further includes a notch positioned adjacent an intersection of the first longitudinal side surface and the top surface, the notch forming a longitudinal sub-surface that is parallel to and indented from the first longitudinal side surface and a top sub-surface that is parallel to and indented from the top surface, wherein the at least one transverse tube includes a curved portion proximate the first longitudinal side surface, the curved portion including a first transverse portion positioned intermediate the top surface and the bottom surface, a vertical portion extending from the first transverse portion toward the top surface, and a second transverse portion extending from the vertical portion to the longitudinal sub-surface intermediate the top surface and the top sub-surface.

In an embodiment, the payment slab further includes at least one fill indicator tube extending through the pavement slab and having a first end positioned at the bottom surface and a second end extending past the top surface, each of the at least one fill indicator tubes being positioned between the second end of a corresponding one of the at least one transverse tube and the second longitudinal side surface, the at least one fill indicator tube being sized and shaped to convey the binder material.

In another embodiment, a pavement slab includes a top surface, a bottom surface opposite the top surface, first and second longitudinal side surfaces, each of which extends from the top surface to the bottom surface, first and second transverse side surfaces, each of which extends from the top surface to the bottom surface, and a longitudinal centerline intermediate the first and second longitudinal side surfaces;

a first transverse tube positioned intermediate the top surface and the bottom surface and extending from the first longitudinal side surface toward the longitudinal centerline, the first transverse tube being sized and shaped to convey a binder material; a first vertical tube extending from the first transverse tube to the bottom surface, the first vertical tube being sized and shaped to convey the binder material; a second transverse tube positioned intermediate the top surface and the bottom surface and extending from the second longitudinal side surface toward the longitudinal centerline, the second transverse tube being sized and shaped to convey the binder material; and a second vertical tube extending from the second transverse tube to the bottom surface, the second vertical tube being sized and shaped to convey the binder material.

In an embodiment, the pavement slab further includes a grout-impermeable barrier extending around a perimeter of the bottom surface. In an embodiment, the grout-impermeable barrier further extends across the bottom surface to subdivide the bottom surface into at least a first region and a second region, the first transverse tube being positioned within the first region and the second transverse tube being positioned within the second region. In an embodiment, the grout-impermeable barrier further extends across the bottom surface to subdivide the bottom surface into a plurality of regions, the first transverse tube being positioned within one of the plurality of regions and the second transverse tube being positioned within another of the plurality of regions.

In an embodiment, the pavement slab further includes a first notch positioned adjacent an intersection of the first longitudinal side surface and the top surface, the first notch forming a first longitudinal sub-surface that is parallel to and indented from the first longitudinal side surface and a first top sub-surface that is parallel to and indented from the top surface, and a second notch positioned adjacent an intersection of the second longitudinal side surface and the top surface, the second notch forming a second longitudinal sub-surface that is parallel to and indented from the second longitudinal side surface and a second top sub-surface that is parallel to and indented from the top surface, wherein the first transverse tube includes a curved portion proximate the first longitudinal side surface, the curved portion of the first transverse tube including a first transverse portion positioned intermediate the top surface and the bottom surface, a vertical portion extending from the first transverse portion toward the top surface, and a second transverse portion extending from the vertical portion to the first longitudinal sub-surface intermediate the top surface and the first top sub-surface, and wherein the second transverse tube includes a curved portion proximate the second longitudinal side surface, the curved portion of the second transverse tube including a first transverse portion positioned intermediate the top surface and the bottom surface, a vertical portion extending from the first transverse portion toward the top surface, and a second transverse portion extending from the vertical portion to the second longitudinal sub-surface intermediate the top surface and the second top sub-surface.

In an embodiment, the pavement slab further includes a first fill indicator tube extending through the pavement slab and having a first end positioned at the bottom surface to a second end extending past the top surface, the first fill indicator tube being positioned between the second end of the first transverse tube and the first longitudinal side surface, the first fill indicator tube being sized and shaped to convey the binder material; and a second fill indicator tube extending through the pavement slab and having a first end positioned at the bottom surface and a second end extending past the top surface, the second fill indicator tube being positioned between the second end of the second transverse tube and the second longitudinal side surface, the second fill indicator tube being sized and shaped to convey the binder material.

DETAILED DESCRIPTION OF THE DRAWINGS

Figure 1:
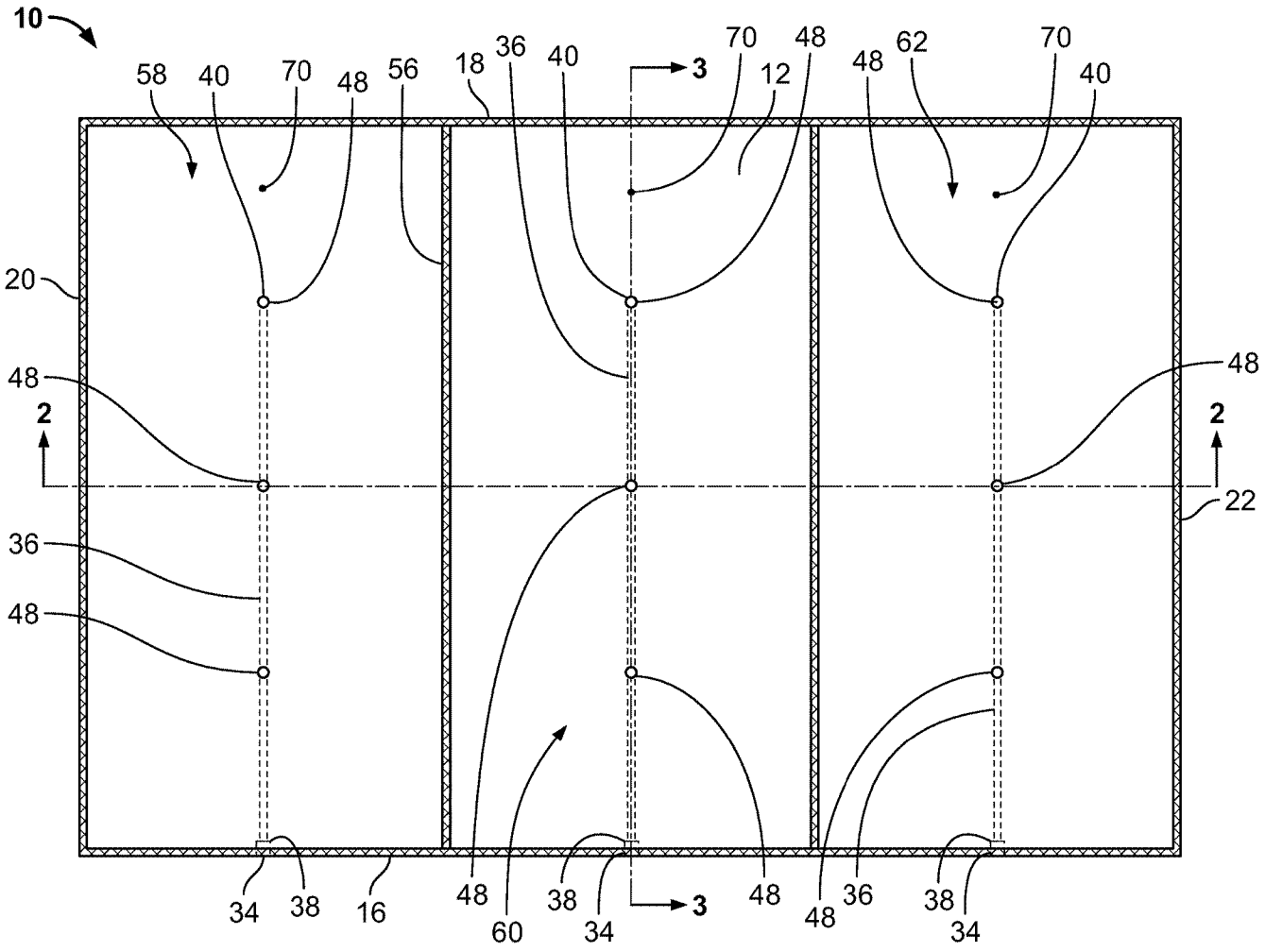
FIG. 1 is a bottom perspective view of a first embodiment of a pavement slab.

FIGS. 1 through 4 illustrate a first exemplary embodiment of a pavement slab 10 (hereinafter "the slab 10") which is constructed in accordance with the present invention. The slab 10 is fabricated with concrete in a conventional manner. In an embodiment, reinforcing bars (not shown in the Figures) are interspersed in the concrete. In an embodiment, the slab 10 has a top surface 12 and a bottom surface 14. First and second longitudinal side surfaces 16, 18 and first and second transverse side surfaces 20, 22 form the perimeter of the slab 10. In an embodiment, the slab 10 can consist of other shapes and sizes. In an embodiment, the slab 10 is positioned on grade, which is prepared by means known in the art. In an embodiment, a connection system for connecting the slab 10 to a further slab (e.g., another one of the slab 10, pre-existing pavement, etc.) may be formed around the perimeter of the slab 10. In an embodiment, the connection system may be as shown in commonly-owned U.S. Pat. No. 8,911,173, which is incorporated by reference herein in its entirety. In an embodiment, one or more lifting anchors may be embedded in the top surface 12.

In an embodiment, a plurality of grout inlets 34 is formed in the first longitudinal side 16. The grout inlets 34 are spaced along the first longitudinal side 16 as will be described hereinafter. In an embodiment, a plurality of transverse grout tubes 36 is formed in the slab 10. Each of the plurality of transverse grout tubes 36 extends from a first end 38, which is located at a corresponding one of the grout inlets 34, to a second end 40, which is positioned proximate the second longitudinal side 18 but does not extend through the second longitudinal side 18. Each of the transverse grout tubes 36 is positioned approximately midway between the top surface 12 and the bottom surface 14. In an embodiment, each of the transverse grout tubes 36 is tubular-shaped. Each of the transverse grout tubes 36 is sized and shaped to receive grout that is pumped into the corresponding one of the grout inlets 34 and convey the grout to the second end 40 of the transverse grout tube 36. In an embodiment, each of the transverse grout tubes 36 has an inside diameter of about ¾". In an embodiment, each of the transverse grout tubes 36 is made from polyvinyl chloride ("PVC"). In an embodiment, each of the transverse grout tubes 36 is made from corrugated PVC. In other embodiments, each of the transverse grout tubes 36 can consist of other shapes, sizes, and materials that are suitable for the operation described herein.

In an embodiment, a plurality of vertical grout tubes 48 is formed in the slab 10. Each of the vertical grout tubes 48 extends vertically downward from a first end 50, which is located within a corresponding one of the transverse grout tubes 36, to a second end 52, which is located at the bottom surface 14 of the slab 10. Each of the vertical grout tubes 48 ends at a corresponding one of a plurality of grout outlets 54, which extend from the second end 52 of the corresponding vertical grout tube 48 and through the bottom surface 14 of the slab 10. Each one of the transverse grout tubes 36 may include a plurality of the vertical grout tubes 48 having corresponding first ends 50 formed therein, and each such vertical grout tube 48 may be spaced along the one of the transverse grout tubes 36 as will be described hereinafter. In an embodiment, each of the vertical grout tubes 48 is tubular-shaped. Each of the vertical grout tubes 48 is sized to receive grout that is pumped into its corresponding one of the transverse grout tubes 36 and convey the grout to the second end 52 of the vertical grout tube 48 and through its corresponding one of the grout outlets 54. In an embodiment, each of the vertical grout tubes 48 has an inside diameter of about ½". In an embodiment, each of the vertical grout tubes 48 is made from PVC. In an embodiment, each of the vertical grout tubes 48 is made from corrugated PVC. In other embodiments, each of the vertical grout tubes 48 can consist of other shapes, sizes, and materials that are suitable for the operation described herein.

In an embodiment, foam tape 56 is affixed to the bottom surface 14 of the slab 10. In an embodiment, the foam tape 56 includes a closed-cell ethylene copolymer foam. In an embodiment, the foam tape 56 includes a foam of the type commercialized under the brand name EVAZOTE by Zotefoams PLC of Croydon, United Kingdom. In an embodiment, the foam tape 56 surrounds the perimeter of the bottom surface 14 of the slab 10 along the edges defined by the bottom surface 14 and the longitudinal sides 16, 18 and the transverse sides 20, 22. In an embodiment, the foam tape 56 is also positioned in lines extending from the first longitudinal side 16 to the second longitudinal side 18, in a direction substantially parallel to the orientation of the transverse sides 20, 22 and in positions that are substantially equidistant between adjacent ones of the transverse grout tubes 36. In such a manner, the foam tape 56 subdivides the bottom surface 14 of the slab 10 into regions, each of which defines an area that is closest to a corresponding one of the transverse grout tubes 36. For example, with reference to FIG. 1, the foam tape 56 divides the bottom surface 14 into regions 58, 60, and 62, each of which corresponds to one of the three transverse grout tubes 36 included in the exemplary slab 10 shown in FIG. 1.

Once the slab 10 has been positioned on grade, installation may be completed by the application of the grout. The grout may be applied by pumping into the grout inlets 34 using any standard mechanism known in the art. In an embodiment, the grout may be applied to all of the grout inlets 34 simultaneously. In an embodiment, the grout may be applied to each of the grout inlets 34 sequentially or non-sequentially. When the grout is applied to one of the grout inlets 34, the grout flows through the grout inlet 34 and along the corresponding one of the transverse grout tubes 36 from the first end 38 to the second end 40. As the grout flows along the transverse grout tubes 36, some of the grout flows downward along each of the vertical grout tubes 48 extending from each one of the transverse grout tubes 36, and through the grout outlets 54 to the subgrade.

Once the grout has flowed out through each of the grout outlets 54 on the bottom surface 14 of the slab 10, the grout will then flow along the bottom surface 14 in all directions away from the grout outlet 54 until its progress is blocked by the foam tape 56. That is, the portion of the foam tape 56 that is positioned around the perimeter of the bottom surface 14 of the slab 10 will prevent the grout from flowing beyond the portion of the subgrade that is within the perimeter of the slab 10. Similarly, the portion of the foam tape 56 that is positioned so as to subdivide the bottom surface 14 into regions (e.g., the regions 58, 60, 62) will prevent the grout from flowing between the regions (e.g., from the region 58 to the region 60). With the flow of the grout controlled in this manner, it may be ensured that the grout that is applied to a given one of the grout inlets 34 will be constrained to a region of known size corresponding to such a one of the grout inlets 34. Consequently, the amount of time required to apply grout to each of the grout inlets 34 will be predictable.

In an embodiment, the slab 10 includes a plurality of fill indicator tubes 70, each of which corresponds to one of the transverse grout tubes 36. Each of the fill indicator tubes 70 extends from a first end 72, which passes through the bottom surface 14 of the slab 10, to a second end 74, which is positioned above the top surface 12 of the slab 10. In an embodiment, each of the fill indicator tubes 70 is positioned between the second end 40 of the corresponding one of the transverse grout tubes 36 and the second transverse side surface 22. In another embodiment, a fill indicator tube 70 corresponding to one of the transverse grout tubes 36 may be placed anywhere within a region (e.g., the region 58) corresponding to the one of the transverse grout tubes 36. In another embodiment, a plurality of fill indicator tubes 70 may be placed in one of the regions (e.g., the region 58) corresponding to one of the transverse grout tubes 36. Once a sufficient amount of the grout has been applied through one of the transverse grout tubes 36 and has flowed down each of the corresponding plurality of the vertical grout tubes 48 such that the grout has flowed across the entire region of the bottom surface 14 corresponding to the one of the transverse grout tubes 36 (e.g., the region 58) and been constrained from further flow by the foam tape 56 surrounding such region, a further amount of the grout applied to the one of the transverse grout tubes 36 will cause the grout to flow through the corresponding one of the fill indicator tubes 70 from its first end 72 to its second end 74. The grout that has flowed out the second end 74 of one of the fill indicator tubes 70 thereby provides a visual indicator to a party who is installing the slab 10 that a sufficient amount of the grout has been pumped into the corresponding one of the transverse grout tubes 36. In an embodiment, each of the fill indicator tubes 70 has an inside diameter of about ½". In an embodiment, each of the fill indicator tubes 70 is made from PVC. In an embodiment, each of the fill indicator tubes 70 is made from corrugated PVC. In other embodiments, each of the fill indicator tubes 70 can consist of other shapes, sizes, and materials that are suitable for the operation described herein.

In an embodiment, the amount of space present between each of the transverse grout tubes 36 and the amount of space present between each of the vertical grout tubes 48 that descend from each one of the transverse grout tubes 36 may be selected so as to ensure that the grout will remain in its flowable, liquid state for as long as required. This may be, for example, for the grout to remain in its flowable, liquid state as it travels along the entire length of one of the transverse grout tubes 36 (i.e., across most of the width of the slab 10), downward through each of the vertical grout tubes 48 descending from the one of the transverse grout tubes 36, through the corresponding grout outlets 54, and from the grout outlets 54 across the entire region (e.g., the region 58) corresponding to the one of the transverse grout tubes 36. By ensuring that the grout flows across the entire bottom surface 14 of the slab (i.e., the entirety of each of the regions 58, 60, 62) before hardening, a solid bond between the slab 10 and the subgrade may be obtained.

In an embodiment, the transverse grout tubes 36 are spaced apart from one another by about four feet along the first longitudinal side 16. In an embodiment, the transverse grout tubes 36 are spaced apart from one another by a distance along the first longitudinal side 16 that is between three feet and five feet. In an embodiment, the transverse grout tubes 36 are spaced apart from one another by a distance along the first longitudinal side 16 that is between two feet and six feet. In an embodiment, the one of the transverse grout tubes 36 that is closest to the first transverse side 20 is located about two feet from the first transverse side 20. In an embodiment, the one of the transverse grout tubes 36 that is closest to the first transverse side 20 is located a distance from the first transverse side 20 that is between one foot and three feet. In an embodiment, the one of the transverse grout tubes 36 that is closest to the first transverse side 20 is located a distance from the first transverse side 20 that is between one foot and four feet. In an embodiment, the vertical grout tubes 48 are spaced apart from one another by about two feet along each of the transverse grout tubes 36. In an embodiment, the vertical grout tubes 48 are spaced apart from one another along each of the transverse grout tubes 36 by a distance that is between one foot and three feet. In an embodiment, the vertical grout tubes 48 are spaced apart from one another along each of the transverse grout tubes 36 by a distance that is between one foot and four feet. In an embodiment, the one of the vertical grout tubes 48 that is closest to the first longitudinal side 16 is located two feet from the first longitudinal side 16. In an embodiment, the one of the vertical grout tubes 48 that is closest to the first longitudinal side 16 is located a distance from the first longitudinal side 16 that is between one foot and three feet. In an embodiment, the one of the vertical grout tubes 48 that is closest to the first longitudinal side 16 is located a distance from the first longitudinal side 16 that is between one foot and four feet.

In some embodiments, no point along the bottom surface 14 of the slab 10 will be further than about three feet away from a nearest one of the grout outlets 54. For some types of the grout, such spacing may be sufficient to ensure that the grout will remain flowable across the required flow distance, as described above. However, it will be apparent to those of skill in the art that such spacing is only exemplary and that any other spacing between the transverse grout tubes 36 and between the vertical grout tubes 48 may be selected as appropriate based on the size of the slab 10, the type of the grout to be used, the characteristics of the subgrade, the requirements or preferences of an installation contractor and/or an entity (e.g., a department of transportation) contracting for installation, etc.

Figures 2, 3:
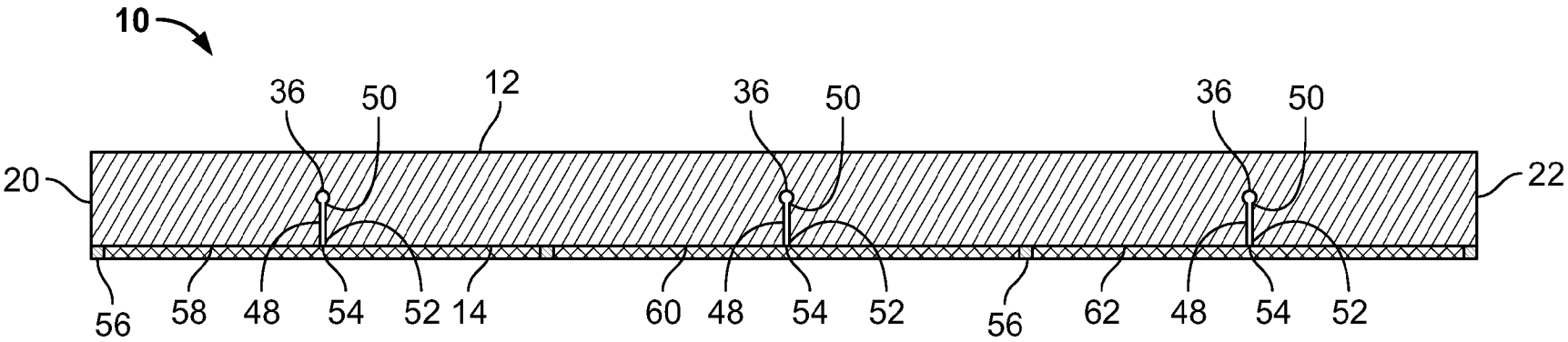
FIG. 2 is a cross-sectional view of the pavement slab of FIG. 1, taken along section line 2-2 and looking in the direction of the arrows of FIG. 1.
FIG. 3 is a cross-sectional view of the pavement slab of FIG. 1, taken along section line 3-3 and looking in the direction of the arrows of FIG. 1.
Figure 4:
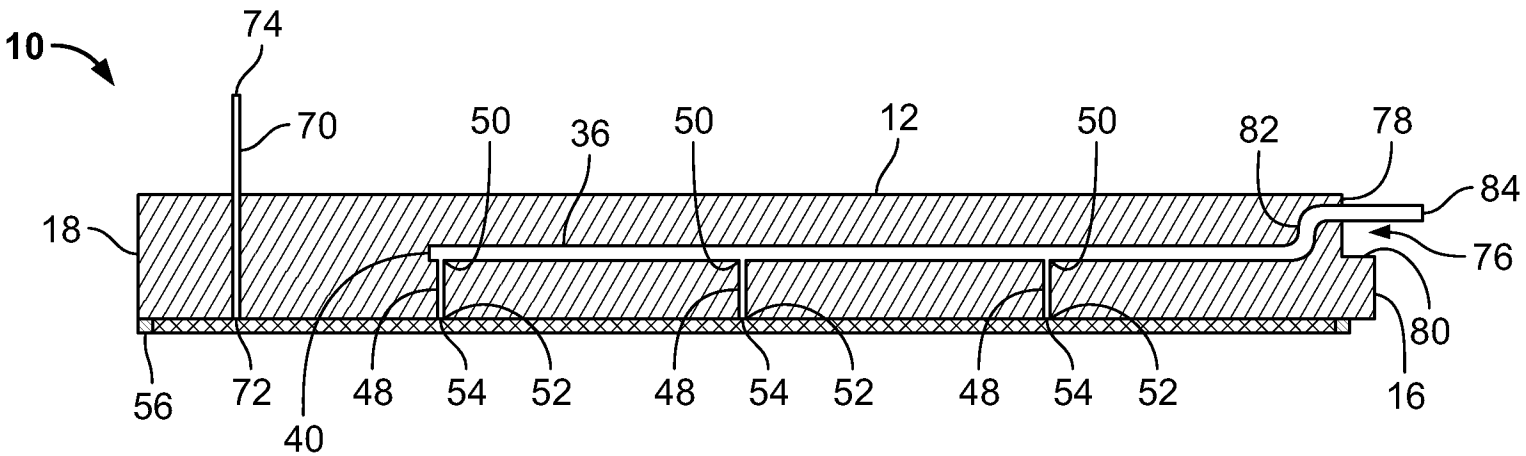
FIG. 4 is a cross-sectional view of an alternate version of the pavement slab shown in FIGS. 1 and 3.
Figure 5:
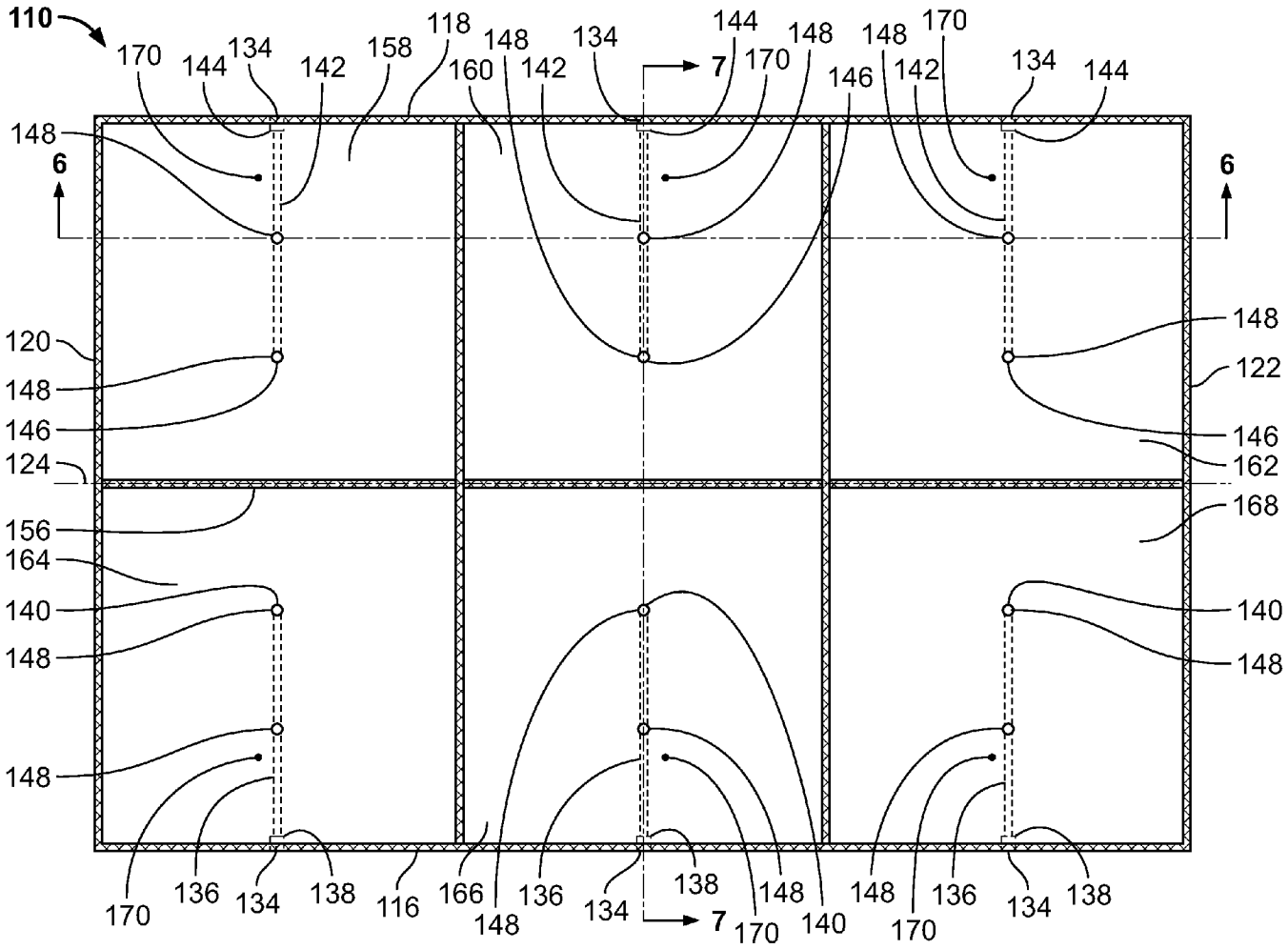
FIG. 5 is a bottom perspective view of a second embodiment of a pavement slab.
Figure 6:
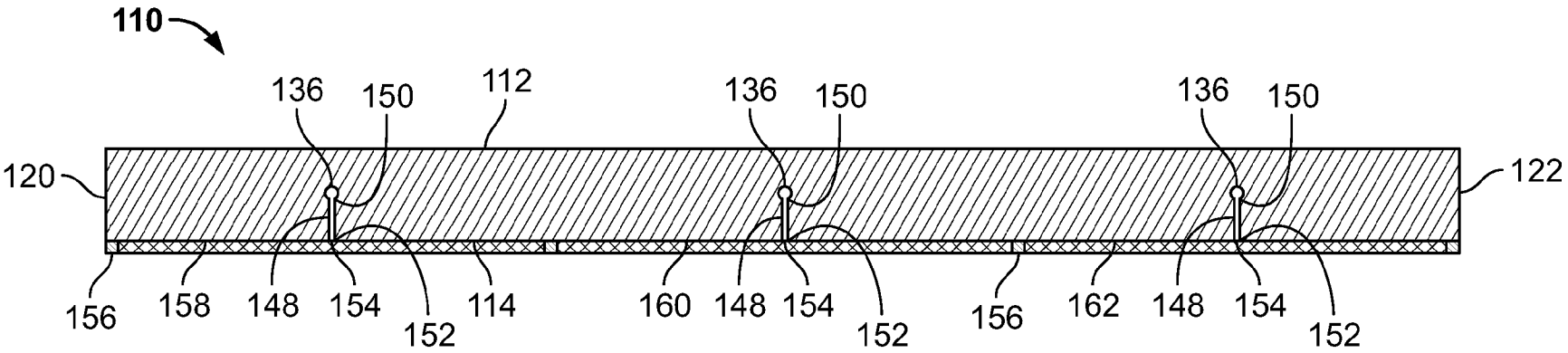
FIG. 6 is a cross-sectional view of the pavement slab of FIG. 5, taken along section line 6-6 and looking in the direction of the arrows of FIG. 5.

In some cases, the slab 10 may be positioned such that the first longitudinal side 16 is inaccessible. This may occur, for example, when the slab 10 is positioned adjacent to another object (e.g., another one of the slab 10, existing pavement, etc.), such that the first longitudinal side 16 is positioned flush against the other object. When such is the case, the grout inlets 34 are, consequently, inaccessible. Referring now to FIG. 4, an alternative version of the slab 10 is illustrated from the same cross-sectional view as shown in FIG. 3. A notch 76 may be formed adjacent the intersection of the first longitudinal side 16 and the top surface 12, resulting in the formation of a longitudinal side sub-surface 78 that is parallel to the first longitudinal side 16 but indented therefrom (i.e., is closer to the second longitudinal side 18 than is the first longitudinal side 16), and in the formation of a top sub-surface 80 that is parallel to the top surface 12 but indented therefrom (i.e., is closer to the bottom surface 14 than is the top surface 12). Each of the transverse grout tubes 36 may include an S-curve 82, in which the transverse grout tube 36 bends away from its position intermediate the top surface 12 and the bottom surface 14 in a direction toward the top surface 12, and back in the transverse direction such that the transverse grout tube 36 passes through the longitudinal side sub-surface 78 to an offset inlet 84 that is positioned adjacent the notch 76 and is positioned between the top sub-surface 80 and the top surface 12. The offset inlet 84 may therefore be accessible even when the slab 10 is positioned adjacent to another object.

In some cases, a type of the grout having a short pot life may be used. This may be the case, for example, if an installation contractor prefers such a type of the grout, or if an entity that is contracting for installation (e.g., a department of transportation) has specified that such a grout should be used. In such cases, an installation process may be impractical if grout must stay in its liquid state as it travels along the entire length of one of the transverse grout tubes 36 (i.e., across most of the width of the slab 10), downward through each of the vertical grout tubes descending from the one of the transverse grout tubes 36, through the corresponding grout outlets 38, and from the grout outlets 38 across the entire region (e.g., the region 42) corresponding to the one of the transverse grout tubes 36.

FIGS. 5 through 8 illustrate a second exemplary embodiment of a pavement slab 110 (hereinafter "the slab 110") which is constructed in accordance with the present invention. Elements of the slab 110 that are analogous to elements of the slab 10 may be described using the same reference numerals, but incremented by 100. The slab 110 is fabricated with concrete in a conventional manner. In an embodiment, reinforcing bars (not shown in the Figures) are interspersed in the concrete. In an embodiment, the slab 110 has a top surface 112 and a bottom surface 114. First and second longitudinal side surfaces 116, 118 and first and second transverse side surfaces 120, 122 form the perimeter of the slab 110. The slab 110 has a longitudinal centerline 124 that is oriented parallel to the first and second longitudinal side surfaces 116, 118 and is positioned midway between the first and second transverse side surfaces 120, 122. It will be apparent to those of skill in the art that the longitudinal centerline 124 is not a physical element of the slab 100, but, rather, is merely a point of reference facilitating the description of the slab 100 herein. In an embodiment, the slab 110 can consist of other shapes and sizes. In an embodiment, the slab 110 is positioned on grade, which is prepared by means known in the art. In an embodiment, a connection system for connecting the slab 110 to a further slab (e.g., another one of the slab 110, pre-existing pavement, etc.) may be formed around the perimeter of the slab 110. In an embodiment, the connection system may be as shown in commonly-owned U.S. Pat. No. 8,911,173, which is incorporated by reference herein in its entirety. In an embodiment, one or more lifting anchors may be embedded in the top surface 112.

In an embodiment, a plurality of grout inlets 134 is formed in the first and second longitudinal sides 116, 118. The grout inlets 134 are spaced along the first and second longitudinal sides 116, 118 as will be described hereinafter. In an embodiment, a first and second plurality of transverse grout tubes 136, 142 are formed in the slab 10. Each of the first plurality of transverse grout tubes 136 extends from a first end 138, which is located at a corresponding one of the grout inlets 134 along the first longitudinal side 116, to a second end 140, which is positioned proximate the longitudinal centerline 124 but does not extend past the longitudinal centerline 124, and is positioned closer to the longitudinal centerline 124 than to the first longitudinal side 116. Each of the second plurality of transverse grout tubes 142 extends from a first end 144, which is located at a corresponding one of the grout inlets 134 along the second longitudinal side 118, to a second end 146, which is positioned proximate the longitudinal centerline 124 but does not extend past the longitudinal centerline 124, and is positioned closer to the longitudinal centerline 124 than to the second longitudinal side 118. Each of the transverse grout tubes 136, 142 is positioned approximately midway between the top surface 112 and the bottom surface 114. In an embodiment, each of the transverse grout tubes 136, 142 is tubular-shaped. Each of the transverse grout tubes 136, 142 is sized and shaped to receive grout that is pumped into the corresponding one of the grout inlets 134 and convey the grout to the second ends 140, 146 of the transverse grout tubes 136, 142, respectively. In an embodiment, each of the transverse grout tubes 136, 142 has an inside diameter of about ¾". In an embodiment, each of the transverse grout tubes 136, 142 is made from PVC. In an embodiment, each of the transverse grout tubes 136, 142 is made from corrugated PVC. In other embodiments, each of the transverse grout tubes 136, 142 can consist of other shapes, sizes, and materials that are suitable for the operation described herein.

In an embodiment, a plurality of vertical grout tubes 148 is formed in the slab 110. Each of the vertical grout tubes 148 extends vertically downward from a first end 150, which is located within a corresponding one of the transverse grout tubes 136, 142 to a second end 152, which is located at the bottom surface 114 of the slab 110. Each of the vertical grout tubes 148 ends at a corresponding one of a plurality of grout outlets 154, which extend from the second end 152 of the corresponding vertical grout tube 148 and through the bottom surface 114 of the slab 110. Each one of the transverse grout tubes 136, 142 may include a plurality of the vertical grout tubes 148 having corresponding first ends 150 formed therein, and each such vertical grout tube 148 may be spaced along the one of the transverse grout tubes 136, 142 as will be described hereinafter. In an embodiment, each of the vertical grout tubes 148 is tubular-shaped. In other embodiments, each of the vertical grout tubes 148 can consist of other shapes. Each of the vertical grout tubes 148 is sized to receive grout that is pumped into its corresponding one of the transverse grout tubes 136, 142 and convey the grout to the second end 152 of the vertical grout tube 148 and through its corresponding one of the grout outlets 154.

In an embodiment, foam tape 156 (i.e., a grout-impermeable barrier) is affixed to the bottom surface 114 of the slab 110. In an embodiment, the foam tape 156 includes a closed-cell ethylene copolymer foam. In an embodiment, the foam tape 156 includes a foam of the type commercialized under the brand name EVAZOTE by Zotefoams PLC of Croydon, United Kingdom. In an embodiment, the foam tape 156 surrounds the perimeter of the bottom surface 114 of the slab 110 along the edges defined by the bottom surface 114 and the first and second longitudinal sides 116, 118 and the transverse sides 120, 122. In an embodiment, the foam tape 156 is also positioned in lines extending from the first longitudinal side 116 to the second longitudinal side 118, in a direction substantially parallel to the orientation of the transverse sides 120, 122 and in positions that are substantially equidistant between adjacent ones of the transverse grout tubes 136, 142, and in a line extending from the first transverse side 120 to the second transverse side 122 in a position that is substantially equidistant between the first longitudinal side 116 and the second longitudinal side 118. In such a manner, the foam tape 156 subdivides the bottom surface 114 of the slab 110 into regions, each of which defines an area that is closest to a corresponding one of the transverse grout tubes 136, 142. For example, with reference to FIG. 5, the foam tape 156 divides the bottom surface 114 into regions 158, 160, 162, 164, 166, and 168, each of which corresponds to one of the six transverse grout tubes 136, 142 included in the exemplary slab 110 shown in FIG. 7.

Once the slab 110 has been positioned on grade, installation may be completed by the application of the grout. The grout may be applied by pumping into the grout inlets 134 using any standard mechanism known in the art. In an embodiment, the grout may be applied to all of the grout inlets 134 simultaneously. In an embodiment, the grout may be applied to each of the grout inlets 134 sequentially or non-sequentially. When the grout is applied to one of the grout inlets 134, the grout flows through the grout inlet 134 and along the corresponding one of the transverse grout tubes 136, 142 from the first end 138, 144 to the second end 140, 146. As the grout flows along the transverse grout tubes 136, 142, some of the grout flows downward along each of the vertical grout tubes 148 extending from each one of the transverse grout tubes 136, 142, and through the grout outlets 154 to the subgrade.

Once the grout has flowed out through each of the grout outlets 154 on the bottom surface 114 of the slab 110, the grout will then flow along the bottom surface 114 in all directions away from the grout outlet 154 until its progress is blocked by the foam tape 156. That is, the portion of the foam tape 156 that is positioned around the perimeter of the bottom surface 114 of the slab 110 will prevent the grout from flowing beyond the portion of the subgrade that is within the perimeter of the slab 110. Similarly, the portion of the foam tape 156 that is positioned so as to subdivide the bottom surface 114 into regions (e.g., the regions 158, 160, 162, 164, 166, 168) will prevent the grout from flowing between the regions (e.g., from the region 158 to the region 160). With the flow of the grout controlled in this manner, it may be ensured that the grout that is applied to a given one of the grout inlets 134 will be constrained to a region of known size corresponding to such a one of the grout inlets 134. Consequently, the amount of time required to apply grout to each of the grout inlets 134 will be predictable.

In an embodiment, the slab 110 includes a plurality of fill indicator tubes 170, each of which corresponds to one of the transverse grout tubes 136, 142. Each of the fill indicator tubes 170 extends from a first end 172, which passes through the bottom surface 114 of the slab 110, to a second end 174, which is positioned above the top surface 112 of the slab 110. In an embodiment, a fill indicator tube 170 corresponding to one of the transverse grout tubes 136, 142 may be placed anywhere within a region (e.g., the region 158)

corresponding to the one of the transverse grout tubes 136, 142. In another embodiment, a plurality of fill indicator tubes 170 may be placed in one of the regions (e.g., the region 158) corresponding to one of the transverse grout tubes 136, 142. Once a sufficient amount of the grout has been applied through one of the transverse grout tubes 136, 142 and has flowed down each of the corresponding plurality of the vertical grout tubes 148 such that the grout has flowed across the entire region of the bottom surface 114 corresponding to the one of the transverse grout tubes 136, 142 (e.g., the region 158) and been constrained from further flow by the foam tape 156 surrounding such region, a further amount of the grout applied to the one of the transverse grout tubes 136, 142 will cause the grout to flow through the corresponding one of the fill indicator tubes 170 from its first end 172 to its second end 174. The grout that has flowed out the second end 174 of one of the fill indicator tubes 170 thereby provides a visual indicator to a party who is installing the slab 110 that a sufficient amount of the grout has been pumped into the corresponding one of the transverse grout tubes 136, 142.

In an embodiment, the amount of space present between each of the transverse grout tubes 136, 142 and the amount of space present between each of the vertical grout tubes 148 that descend from each one of the transverse grout tubes 136, 142 may be selected so as to ensure that the grout will remain in its flowable, liquid state for as long as required. This may be, for example, for the grout to remain in its flowable, liquid state as it travels along the entire length of one of the transverse grout tubes 136, 142 (i.e., across approximately half of the width of the slab 110), downward through each of the vertical grout tubes 148 descending from the one of the transverse grout tubes 136, 142, through the corresponding grout outlets 154, and from the grout outlets 154 across the entire region (e.g., the region 158) corresponding to the one of the transverse grout tubes 136, 142. By ensuring that the grout flows across the entire bottom surface 114 of the slab (i.e., the entirety of each of the regions 158, 160, 162, 164, 166, 168) before hardening, a solid bond between the slab 110 and the subgrade may be obtained.

In an embodiment, the transverse grout tubes 136, 142 may be spaced apart from one another by about four feet along the first longitudinal side 116, the one of the transverse grout tubes 136, 142 that is closest to the first transverse side 120 may be located two feet from the first transverse side 120, the vertical grout tubes 148 may be spaced apart from one another by about one foot, four inches along each of the transverse grout tubes 136, 142, and the one of the vertical grout tubes 148 that is closest to the corresponding one of the longitudinal sides 116, 118 may be located one foot, four inches from the corresponding longitudinal side 116. It will be apparent to those of skill in the art that, in such an embodiment, no point along the bottom surface 114 of the slab 110 will be further than about two and a half feet away from a nearest one of the grout outlets 154. For some types of the grout, such spacing may be sufficient to ensure that the grout will remain flowable across the required flow distance, as described above. However, it will be apparent to those of skill in the art that such spacing is only exemplary and that any other spacing between the transverse grout tubes 136, 142 and between the vertical grout tubes 148 may be selected as appropriate based on the size of the slab 110, the type of the grout to be used, the characteristics of the subgrade, the requirements or preferences of an installation contractor and/or an entity (e.g., a department of transportation) contracting for installation, etc.

Figure 7:
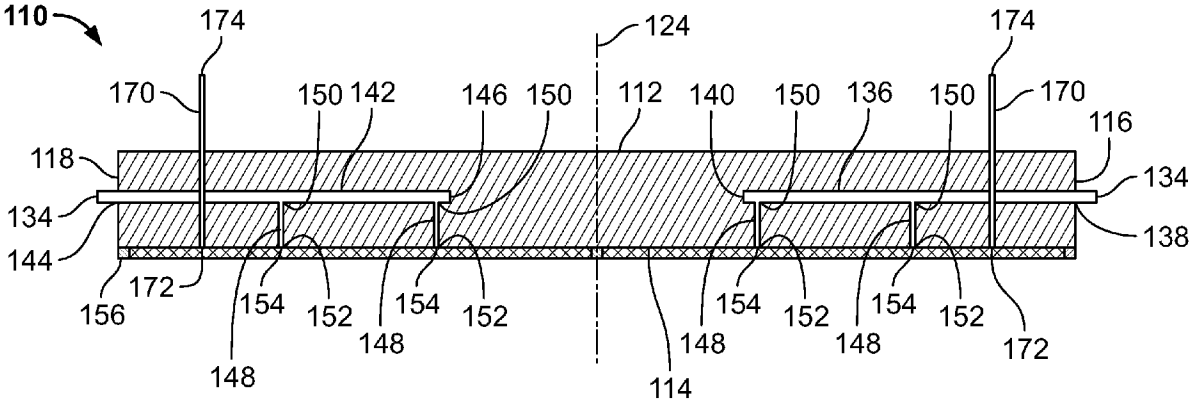
FIG. 7 is a cross-sectional view of the pavement slab of FIG. 5, taken along section line 7-7 and looking in the direction of the arrows of FIG. 5.
Figure 8:
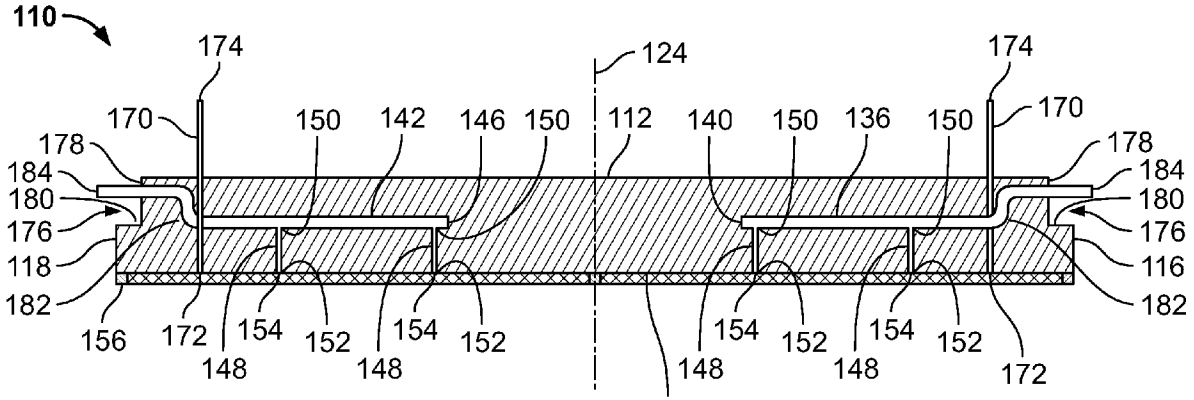
FIG. 8 is a cross-sectional view of an alternate version of the pavement slab shown in FIGS. 5 and 7.

In some cases, the slab 110 may be positioned such that the first longitudinal side 116 and/or the second longitudinal side 118 is inaccessible. This may occur, for example, when the slab 110 is positioned adjacent to another object (e.g., another one of the slab 110, existing pavement, etc.) such that the first longitudinal side 116 is positioned flush against the other object. When such is the case, the grout inlets 134 are, consequently, inaccessible. Referring now to FIG. 8, an alternative version of the slab 110 is illustrated from the same cross-sectional view as shown in FIG. 7. Notches 176 may be formed adjacent the intersection of the first longitudinal side 116 and the top surface 112 and adjacent the intersection of the second longitudinal side 118 and the top surface 112, resulting in the formation of longitudinal side sub-surfaces 178 that are parallel to the first and second longitudinal sides 116, 118 but indented therefrom (i.e., the longitudinal side sub-surface 178 that is formed proximate the first longitudinal side 116 is closer to the second longitudinal side 118 than is the first longitudinal side 116; the longitudinal side sub-surface 178 that is formed proximate the second longitudinal side 118 is closer to the first longitudinal side 116 than is the second longitudinal side 118) and top sub-surfaces 180 that are parallel to the top surface 112 but indented therefrom (i.e., are closer to the bottom surface 114 than is the top surface 112). Each of the transverse grout tubes 136, 142 may include an S-curve 182, in which the transverse grout tube 136, 142 bends away from its position intermediate the top surface 112 and the bottom surface 114 in a direction toward the top surface 112, and bends back in the transverse direction such that the transverse grout tube 136, 142 passes through the longitudinal side sub-surface 178 to an offset inlet 184 that is positioned adjacent the notch 176 and is positioned between the top sub-surface 180 and the top surface 112. The offset inlet 184 may therefore be accessible even when the slab 110 is positioned adjacent to another object.

It should be understood that the embodiments described herein are merely exemplary in nature and that a person skilled in the art may make many variations and modifications thereto without departing from the scope of the present invention. All such variations and modifications, including those discussed above, are intended to be included within the scope of the invention.

What is claimed is:

1. A pavement slab, comprising:

a top surface, a bottom surface opposite the top surface, first and second longitudinal side surfaces, each of which extends from the top surface to the bottom surface, and first and second transverse side surfaces, each of which extends from the top surface to the bottom surface;

at least one transverse tube positioned intermediate the top surface and the bottom surface and extending from an inlet at the first longitudinal side surface to a second end intermediate the first and second longitudinal side surfaces, the at least one transverse tube being sized and shaped to convey a binder material;

at least one vertical tube extending from each of the at least one transverse tube to the bottom surface, the at least one vertical tube being sized and shaped to convey the binder material; and a notch positioned adjacent an intersection of the first longitudinal side surface and the top surface, the notch forming a longitudinal sub-surface that is parallel to and indented from the first longitudinal side surface and a top sub-surface that is parallel to and indented from the top surface, wherein the at least one transverse tube includes a curved portion proximate the first longitudinal side surface, the curved portion including a first transverse portion positioned intermediate the top surface and the bottom surface, a vertical portion extending from the first transverse portion toward the top surface, and a second transverse portion extending from the vertical portion to the longitudinal sub-surface intermediate the top surface and the top sub-surface.

2. The pavement slab of claim 1, wherein the at least one transverse tube includes a plurality of transverse tubes.

3. The pavement slab of claim 1, wherein the at least one vertical tube extending from each of the at least one transverse tube includes a plurality of vertical tubes extending from each of the at least one transverse tube.

4. The pavement slab of claim 1, further comprising a grout-impermeable barrier extending around a perimeter of the bottom surface.

5. The pavement slab of claim 4, wherein the grout-impermeable barrier includes foam tape affixed to the bottom surface.

6. The pavement slab of claim 4, wherein the grout-impermeable barrier further extends across the bottom surface to subdivide the bottom surface into a plurality of regions, wherein the at least one transverse tube includes a plurality of transverse tubes, and wherein each of the plurality of transverse tubes is positioned within a corresponding one of the plurality of regions.

7. The pavement slab of claim 2, wherein a distance between a first one of the plurality of transverse tubes and a second one of the plurality of transverse tubes is configured so as to enable the binder material to flow across an entirety of the bottom surface while remaining in a liquid state.

8. The pavement slab of claim 7, wherein the distance between a first one of the plurality of transverse tubes and a second one of the plurality of transverse tubes is in a range between three feet and five feet.

9. The pavement slab of claim 7, wherein a distance between the first one of the plurality of transverse tubes and the first transverse side surface is in a range between one foot and four feet.

10. The pavement slab of claim 1, wherein a distance between a first one of the at least one vertical tube extending from a first one of the at least one transverse tube and a second one of the at least one vertical tube extending from the first one of the at least one transverse tube is configured so as to enable the binder material to flow across an entirety of the bottom surface while remaining in a liquid state.

11. The pavement slab of claim 10, wherein the distance between the first one of the at least one vertical tube and the second one of the at least one vertical tube is in a range between one foot and four feet.

12. The pavement slab of claim 10, wherein each of the at least one vertical tube is positioned such that no point on the bottom surface is more than three feet from one of the at least one vertical tube.

13. A pavement slab, comprising:

a top surface, a bottom surface opposite the top surface, first and second longitudinal side surfaces, each of which extends from the top surface to the bottom surface, first and second transverse side surfaces, each of which extends from the top surface to the bottom surface, and a longitudinal centerline intermediate the first and second longitudinal side surfaces;

a first transverse tube positioned intermediate the top surface and the bottom surface and extending from the first longitudinal side surface toward the longitudinal centerline, the first transverse tube being sized and shaped to convey a binder material;

a first vertical tube extending from the first transverse tube to the bottom surface, the first vertical tube being sized and shaped to convey the binder material;

a second transverse tube positioned intermediate the top surface and the bottom surface and extending from the second longitudinal side surface toward the longitudinal centerline, the second transverse tube being sized and shaped to convey the binder material;

a second vertical tube extending from the second transverse tube to the bottom surface, the second vertical tube being sized and shaped to convey the binder material;

a first notch positioned adjacent an intersection of the first longitudinal side surface and the top surface, the first notch forming a first longitudinal sub-surface that is parallel to and indented from the first longitudinal side surface and a first top sub-surface that is parallel to and indented from the top surface, and a second notch positioned adjacent an intersection of the second longitudinal side surface and the top surface, the second notch forming a second longitudinal sub-surface that is parallel to and indented from the second longitudinal side surface and a second top sub-surface that is parallel to and indented from the top surface, wherein the first transverse tube includes a curved portion proximate the first longitudinal side surface, the curved portion of the first transverse tube including a first transverse portion positioned intermediate the top surface and the bottom surface, a vertical portion extending from the first transverse portion toward the top surface, and a second transverse portion extending from the vertical portion to the first longitudinal sub-surface intermediate the top surface and the first top sub-surface, and wherein the second transverse tube includes a curved portion proximate the second longitudinal side surface, the curved portion of the second transverse tube including a first transverse portion positioned intermediate the top surface and the bottom surface, a vertical portion extending from the first transverse portion toward the top surface, and a second transverse portion extending from the vertical portion to the second longitudinal sub-surface intermediate the top surface and the second top sub-surface.

14. The pavement slab of claim 13, further comprising a grout-impermeable barrier extending around a perimeter of the bottom surface.

15. The pavement slab of claim 14, wherein the grout-impermeable barrier further extends across the bottom surface to subdivide the bottom surface into at least a first region and a second region, the first transverse tube being positioned within the first region and the second transverse tube being positioned within the second region.

16. The pavement slab of claim 14, wherein the grout-impermeable barrier further extends across the bottom surface to subdivide the bottom surface into a plurality of regions, the first transverse tube being positioned within one of the plurality of regions and the second transverse tube being positioned within another of the plurality of regions.

17. A pavement slab, comprising:

a top surface, a bottom surface opposite the top surface, first and second longitudinal side surfaces, each of which extends from the top surface to the bottom surface, and first and second transverse side surfaces, each of which extends from the top surface to the bottom surface;

at least one transverse tube positioned intermediate the top surface and the bottom surface and extending from an inlet at the first longitudinal side surface to a second end intermediate the first and second longitudinal side surfaces, the at least one transverse tube being sized and shaped to convey a binder material;

at least one vertical tube extending from each of the at least one transverse tube to the bottom surface, the at least one vertical tube being sized and shaped to convey the binder material; and at least one fill indicator tube extending through the pavement slab and having a first end positioned at the bottom surface and a second end extending past the top surface, each of the at least one fill indicator tubes being positioned between the second end of a corresponding one of the at least one transverse tube and the second longitudinal side surface, the at least one fill indicator tube being sized and shaped to convey the binder material.

18. A pavement slab, comprising:

a top surface, a bottom surface opposite the top surface, first and second longitudinal side surfaces, each of which extends from the top surface to the bottom surface, first and second transverse side surfaces, each of which extends from the top surface to the bottom surface, and a longitudinal centerline intermediate the first and second longitudinal side surfaces;

a first transverse tube positioned intermediate the top surface and the bottom surface and extending from the first longitudinal side surface toward the longitudinal centerline, the first transverse tube being sized and shaped to convey a binder material;

a first vertical tube extending from the first transverse tube to the bottom surface, the first vertical tube being sized and shaped to convey the binder material;

a second transverse tube positioned intermediate the top surface and the bottom surface and extending from the second longitudinal side surface toward the longitudinal centerline, the second transverse tube being sized and shaped to convey the binder material;

a second vertical tube extending from the second transverse tube to the bottom surface, the second vertical tube being sized and shaped to convey the binder material;

a first fill indicator tube extending through the pavement slab and having a first end positioned at the bottom surface to a second end extending past the top surface, the first fill indicator tube being positioned between the second end of the first transverse tube and the first longitudinal side surface, the first fill indicator tube being sized and shaped to convey the binder material; and a second fill indicator tube extending through the pavement slab and having a first end positioned at the bottom surface and a second end extending past the top surface, the second fill indicator tube being positioned between the second end of the second transverse tube and the second longitudinal side surface, the second fill indicator tube being sized and shaped to convey the binder material.

* * * * *